US007542899B2

(12) United States Patent
Etter

(10) Patent No.: US 7,542,899 B2
(45) Date of Patent: Jun. 2, 2009

(54) METHOD AND APPARATUS FOR ADJUSTING THE LEVEL OF A SPEECH SIGNAL IN ITS ENCODED FORMAT

(75) Inventor: Walter Etter, Wayside, NJ (US)

(73) Assignee: Alcatel-Lucent USA Inc., Murray Hill, NJ (US)

( * ) Notice: Subject to any disclaimer, the term of this patent is extended or adjusted under 35 U.S.C. 154(b) by 774 days.

(21) Appl. No.: 10/674,721

(22) Filed: Sep. 30, 2003

(65) Prior Publication Data

US 2005/0071155 A1 Mar. 31, 2005

(51) Int. Cl.
*G10L 19/14* (2006.01)
*G10L 11/00* (2006.01)
*G10L 19/00* (2006.01)

(52) U.S. Cl. ..... 704/225; 704/200; 704/201

(58) Field of Classification Search ..... 704/225, 704/200, 201
See application file for complete search history.

(56) References Cited

U.S. PATENT DOCUMENTS 5,519,807 A * 5/1996 Cellario et al. ..... 704/224
6,438,518 B1 * 8/2002 Manjunath et al. ..... 704/219

OTHER PUBLICATIONS

U.S. Appl. No. 10/449,288, filed May 30, 2003, J. Cezanne et al.

* cited by examiner

*Primary Examiner*—Richemond Dorvil
*Assistant Examiner*—Douglas C Godbold
(74) *Attorney, Agent, or Firm*—Gregory J. Murgia

(57) ABSTRACT

A method and apparatus for modifying the level of a speech signal is provided in which the gain parameter in the encoded speech signal is changed in a variable and cyclical manner over time. More specifically, a speech signal is encoded as a bit stream and the speech signal is transported in frames with each frame potentially being further sub-divided into sub-frames. The gain parameter, e.g., fixed codebook gain, is modified in the speech signal in a variable and cyclical manner over a plurality of frames or sub-frames so that gain is temporally dispersed over a plurality of frames or sub-frames. In effect, the change in the amount of gain applied to the signal is effectively dispersed over time so that gradual and accurate changes in the output level of the signal can be achieved to better match actual signal conditions.

9 Claims, 6 Drawing Sheets

(NO GAIN DISPERSION)

(GAIN DISPERSION)

METHOD AND APPARATUS FOR ADJUSTING THE LEVEL OF A SPEECH SIGNAL IN ITS ENCODED FORMAT

TECHNICAL FIELD

The present invention relates generally to processing speech signals and, more specifically, to adjusting gain of speech signals for enhancing voice quality.

BACKGROUND OF THE INVENTION

Cellular phones and networks employ speech codecs to reduce the data rate in order to make efficient use of the bandwidth resources in the radio interface. In a mobile-to-mobile call, the PCM (pulse code modulation) speech signal is first encoded into a lower-rate bit stream by the speech codec of mobile A, transmitted over the network, and then decoded back into a PCM signal in the speech codec of mobile B. Speech codecs are also used in Internet-based transmission in conjunction with IP (Internet Protocol) phones. As in cellular phones, the reduced data rate due to speech codecs allows for more throughput, that is, more telephone conversation, for a given transmission medium.

With the increased reliance on wireless communications, voice quality has become an important consideration in wireless systems. Various improvements have been made over the years to improve voice quality including, for example, improving the speech codecs used in the networks, using tandem free networks, and so on. Various signal processing techniques for enhancing voice quality are also well-known and pervasive throughout the networks, e.g., acoustic echo control, noise compensation, noise reduction, and automatic gain control. As is well known, these techniques typically use some form of noise estimation and subsequent gain adjustment/modification to improve the speech signal quality. However, conventional gain modification arrangements are limited in accuracy and effectiveness.

For example, FIG. 1 illustrates the effect of incrementing the fixed codebook gain in a conventional manner for an exemplary Global System for Mobile Communications (GSM) cellular system using Adaptive Multi-Rate (AMR) speech coders in the 12.2 kbps mode. As is well known, this speech coder models the excitation of a speech signal with a fixed codebook portion and a variable codebook portion. The fixed codebook portion is determined by the fixed codebook vector and the fixed codebook gain in an AMR codec. By incrementing the fixed codebook gain, the level/volume of the speech signal is correspondingly changed. For example, in the encoder, the fixed codebook gain is quantized using a quantization table consisting of, e.g., 31 values, and only the index (e.g., increment, step, etc.) into the quantization table is transmitted and provided to the decoder. In the decoder, the index is translated to obtain the fixed codebook gain value from the quantization table (look up table), so changing the index (e.g., increment, step) causes the corresponding change in the level/volume.

More specifically, FIGS. 1A and 1B show this corresponding relationship between actual (absolute) output levels and the changes (increments) to the fixed codebook gain index. For purposes of this illustration, the input signal to the AMR codec is white noise. FIG. 1A shows a plot of the actual output levels as a function of the increment of the fixed codebook gain index. FIG. 1B shows the sequential increment to output level as a function of the fixed codebook gain being incremented, i.e., from index 0 to index 1, from index 1 to index 2, and so on.

Referring to FIG. 1A, the output level at index 0 (i.e., when no increment is applied to the fixed codebook gain index), was measured to be approximately −39.8 dBm for the white noise signal (as shown by reference 201). When a constant increment of one (1) is applied to the fixed codebook table index for the entire duration of the signal, an output level of approximately −36.4 dBm was measured throughout the entire signal (as shown by reference 202 in FIG. 1A). As such, the difference (increment) in the output level between increment 0 and increment 1 is approximately 3.4 dB, as shown by reference 203 in FIG. 1B. When a constant increment of two (2) is applied to the fixed codebook gain index, an output level of approximately −33.0 dBm results (shown by reference 205 in FIG. 1A) and the further increment (difference between increment 1 and increment 2) is again approximately 3.4 dB as shown by reference 206 in FIG. 1B, and so on.

As shown for increments of approximately 10 or more (reference 211), a saturation effect occurs in that the calculated index may be frequently greater than the table length of 31, in which case it has to be limited to 31. Moreover, the output signal may be limited by other mechanisms in the decoder. Consequently, saturation occurs and the output increment becomes less than 3.4 dB as shown by reference 212.

The relationship between output levels and index increments in fixed codebook gain, as shown in FIGS. 1A and 1B, illustrate a significant disadvantage in modifying the fixed codebook gain in this manner. In particular, the adjustments made to the fixed codebook gain in an encoded signal are limited to "coarse" adjustments, at least in the unsaturated regime, resulting in "coarse" adjustment of the decoded output signal. Stated otherwise, increments (e.g. 1,2 3, and so on) of the fixed codebook gain index results in gain modifications of the output signal in multiples of 3.4 dB steps (e.g., 3.4 dB, 6.8 dB, 10.2 dB, and so on), which can result in under-compensating or over-compensating the gain of the modified output signal.

SUMMARY OF THE INVENTION

The shortcomings of prior arrangements for modifying gain in a speech signal are overcome according to the principles of the invention by changing the gain parameter in the speech signal in a variable and cyclical manner over time. In effect, the change in the amount of gain applied to the signal is effectively dispersed over time so that gradual changes in the output level of the signal can be achieved to better match actual signal conditions.

In one illustrative embodiment of the invention, the speech signal is encoded as a bit stream and the speech signal is transported in frames with each frame being further subdivided into sub-frames. The gain parameter, e.g., fixed codebook gain, is modified in the speech signal in a variable and cyclical manner over a plurality of sub-frames so that gain is temporally dispersed over a plurality of sub-frames.

The gain dispersion technique according to the principles of the invention can be advantageously used in conjunction with voice quality enhancement functions including, but not limited to, noise compensation, noise reduction, acoustic echo control, and automatic gain control. According to the principles of the invention, enhancement of the speech signal can be accurately adapted to actual signal conditions because the quantization level of the gain can be set with a resolution that allows for closely matching the smallest perceivable differences in the speech signal, e.g. the smallest perceivable sound level (loudness) difference. By contrast, the prior art arrangements only allow for coarse quantization (adjustment), e.g., on the order of approximately 3.5 dB steps/increments.

BRIEF DESCRIPTION OF THE DRAWINGS

A more complete understanding of the present invention may be obtained from consideration of the following detailed description of the invention in conjunction with the drawing, with like elements referenced with like reference numerals, in which.

DETAILED DESCRIPTION

Figure 2:
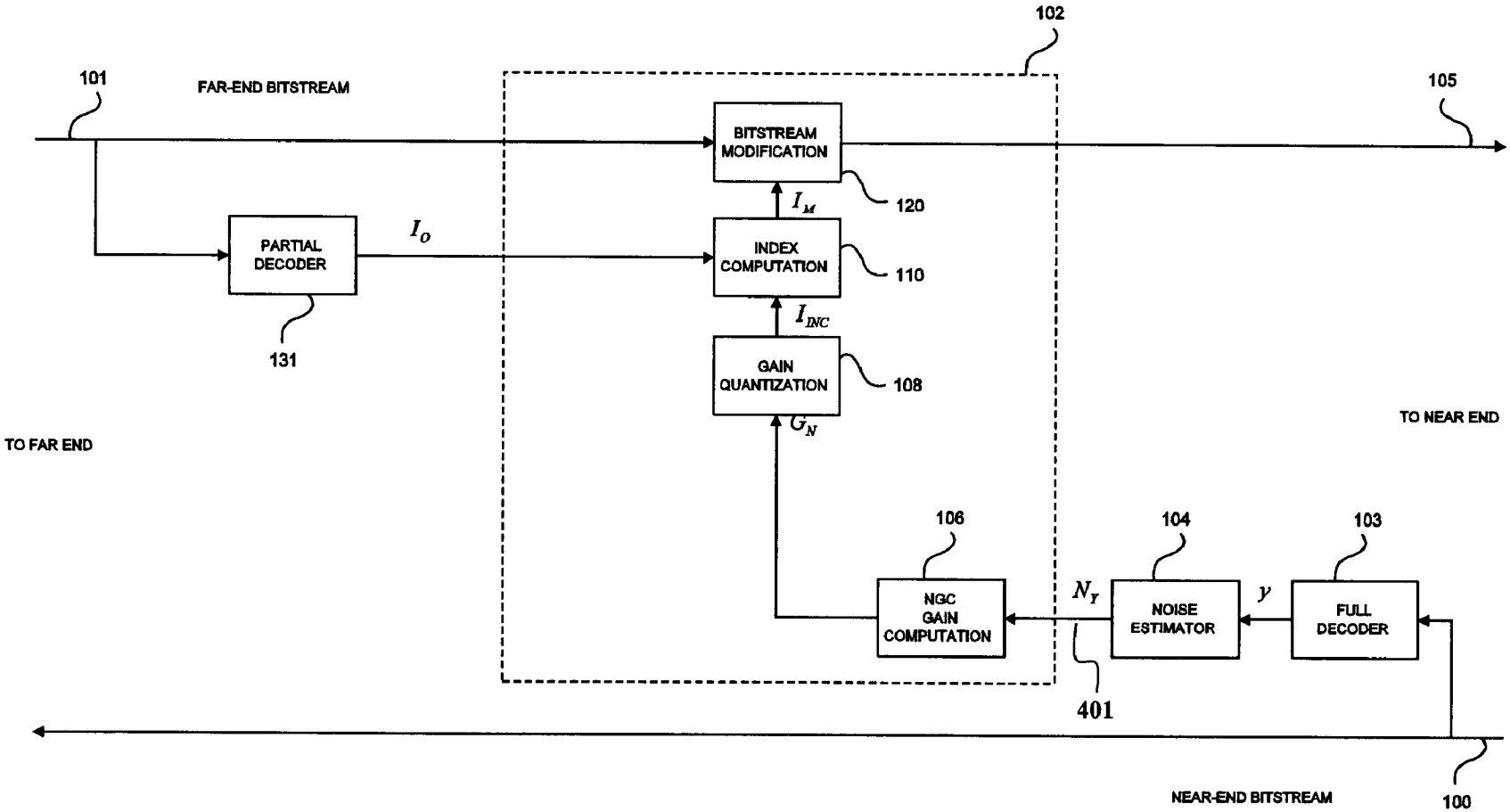
FIG. 2 is a simplified block diagram illustrating bit stream-based noise compensation.

In previously filed U.S. patent application Ser. No. 10/449,288, which is incorporated by reference as if set forth fully herein, I recognized problems associated with prior voice quality enhancement techniques and developed an improved method based on direct processing of the bit stream in the network using a subset of decoded parameters from the speech signal to modify selected parameters in the speech signal. Referring now to FIG. 2 of the present application, there is shown a simplified block diagram of a noise compensation arrangement that can be used, for example, in conjunction with the teachings in aforementioned U.S. patent application Ser. No. 10/449,288.

As shown, near-end noise is compensated by enhancing the far-end signal. More specifically, decoder 103 regenerates near-end PCM signal y by decoding near-end bit stream 100. In a conventional manner, noise estimator 104 derives near-end noise level $N_Y$ from PCM signal y and provides that as input to noise compensation unit 102. More specifically, noise-adaptive gain control (NGC) computation unit 106 receives near-end noise level $N_Y$ as input and computes gain $G_N$ based on noise level $N_Y$ and gain quantization unit 108 then quantizes gain $G_N$. For this purpose, the desired gain $G_N$ is quantized in steps provided by the fixed codebook gain table. More specifically, the gain $G_N$ is expressed in index increments, represented as $I_{INC}$, with respect to the fixed codebook gain table. The function of index computation unit 110 is to compute a new index for the fixed codebook gain, which then is used to modify the far-end bit stream 101. More specifically, the modified fixed codebook gain $I_M$ is computed in index computation unit 110 by adding the index increment $I_{INC}$ to the fixed codebook gain index $I_O$, which is decoded and extracted by decoder 131 from the far-end bit stream speech. The sum of both values is further limited to fixed codebook gain table length $L_T$, to warrant a valid table index. Stated otherwise, the modified fixed codebook gain can be expressed as $I_M=\min(I_0+I_{INC}, L_T)$. The far-end bit stream 101 is then modified in bit stream processor 120 by replacing the original fixed codebook gain index of the far-end speech signal (bit stream 101) with the modified fixed codebook gain index $I_M$, to generate modified far-end bit stream 105.

Figure 3:
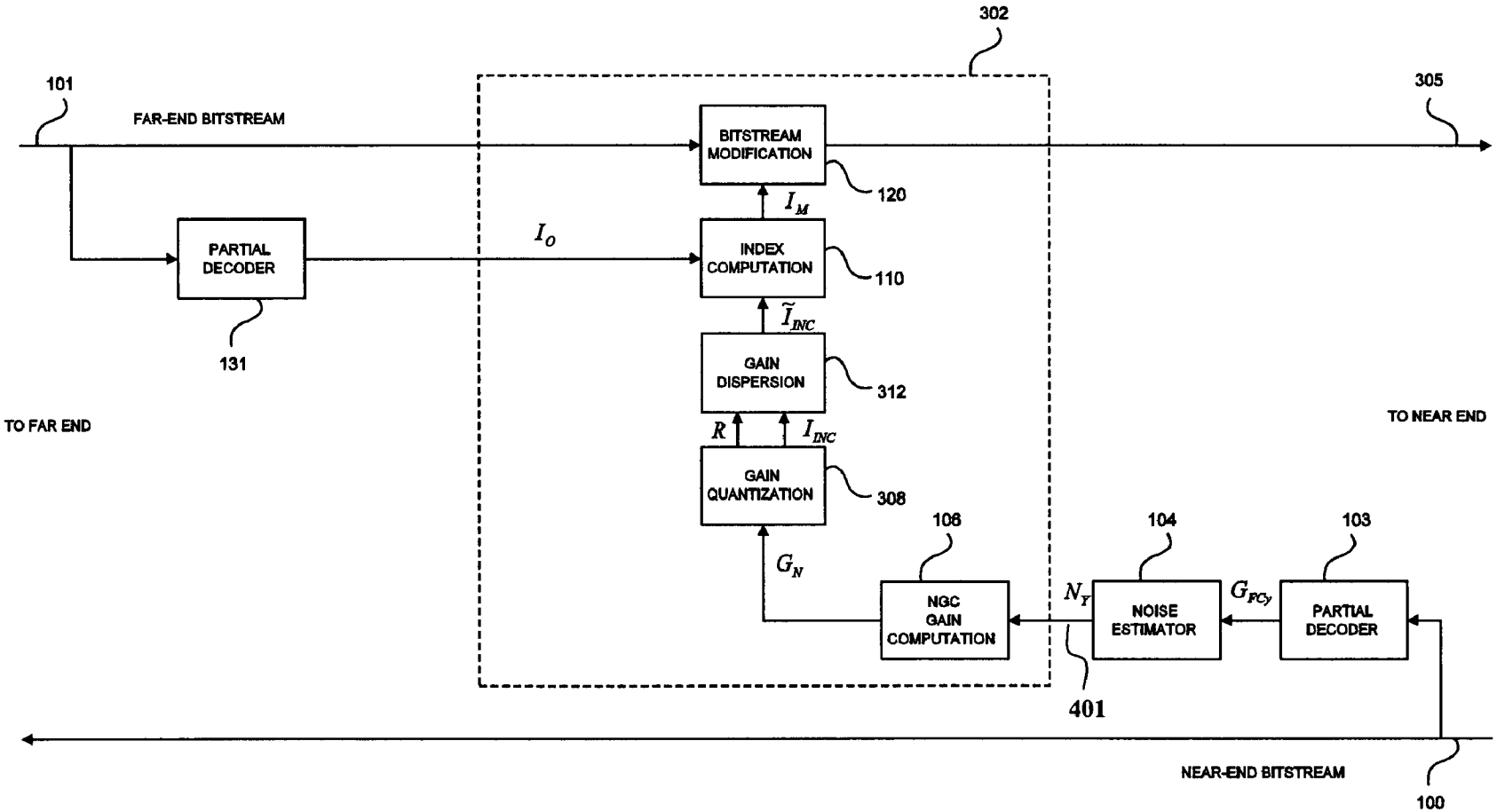
FIG. 3 is a simplified block diagram of one illustrative embodiment of a noise compensation arrangement in which the principles of the invention can be applied.

FIG. 3 shows one illustrative embodiment of a noise compensation arrangement incorporating the principles of the invention. The arrangement shown in FIG. 3 includes some similar components (with the same reference numerals) as those shown in FIG. 2 and, for sake of brevity, the function of these elements will not be described again in detail.

As shown in FIG. 3, gain quantization unit 308 receives gain $G_N$ of the noise signal as computed by noise-adaptive gain control (NGC) computation unit 106 in a similar manner as described for the arrangement shown in FIG. 2. However, in this illustrative embodiment, gain quantization unit 308 provides both the quantized gain increment via the table index increment $I_{INC}$ as well as the remainder R, which is a fractional number between 0 and 1. As previously described in FIG. 2, the desired gain $G_N$ is quantized in steps provided by the fixed codebook gain table. The quantized gain $G_N$ is expressed in index increments, represented as $I_{INC}$, with respect to the fixed codebook gain table. As opposed to the arrangement in FIG. 2, the quantization error expressed by the remainder R is now provided by the gain quantization unit 308. In other words, gain quantization unit 308 provides a fractional index increment with $I_{INC}$ being the integer part and R being the remainder.

According to the principles of the invention, gain dispersion unit 312, responsive to the quantized gain increment (via the table index increment $I_{INC}$) and the corresponding remainder R, generates a time-dispersed index increment $\tilde{I}_{INC}$. More specifically, the time-dispersed index increment $\tilde{I}_{INC}$ is the sum of the base index increment $I_{INC}$ and a cyclical increment $\Delta_{INC}$, i.e., $\tilde{I}_{INC}=I_{INC}+\Delta_{INC}$. The cyclical increment $\Delta_{INC}$ is typically a time-varying integer of either 1 or 0 and determined by remainder R. While time-dispersed index increment $\tilde{I}_{INC}$ and its cyclical component $\Delta_{INC}$ will be described in further detail below, generally, the closer remainder R is to zero, the less frequent $\Delta_{INC}$ takes on the value 1 and, the closer remainder R is to one, the more frequent $\Delta_{INC}$ takes on the value 1. Index computation unit 110 (as in FIG. 2) then computes a new index $I_M$ for the fixed codebook gain. In this embodiment, index computation unit 110 computes a new index $I_M$ for the fixed codebook gain by adding the time-dispersed index increment $\tilde{I}_{INC}$ to the original fixed codebook gain index $I_O$ (which is decoded and extracted by decoder 131 from the far-end bit stream), and subjecting it to the limitation of the table length $L_T$, i.e., $I_M=\min(I_0+\tilde{I}_{INC},L_T)$. As will be described in further detail with respect to FIG. 4 below, only the cyclical component $\Delta_{INC}$ of the time-dispersed Index increment $\tilde{I}_{INC}$ is time-dispersed.

The far-end bit stream 101 is then modified in bit stream processor 120 by replacing the original fixed codebook gain index of the far-end speech signal (bit stream 101) with the modified fixed codebook gain index $I_M$, to generated modified far-end bit stream 305.

Figure 1A:
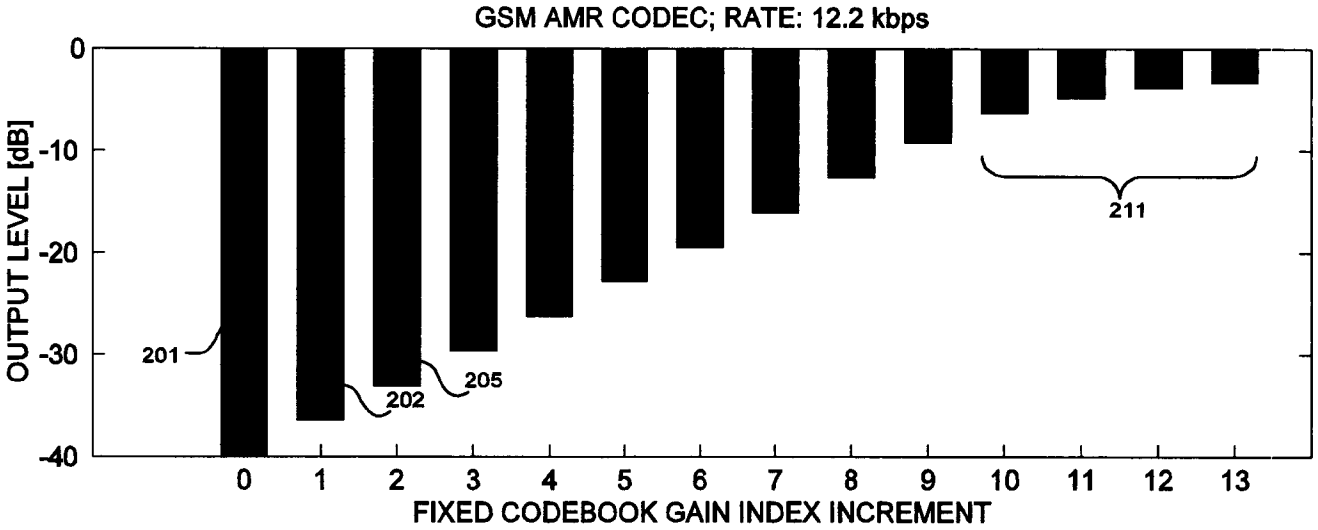
FIGS. 1A and 1B show graphical plots illustrating the effect of incrementing fixed codebook gain in a conventional codec.
Figure 1B:
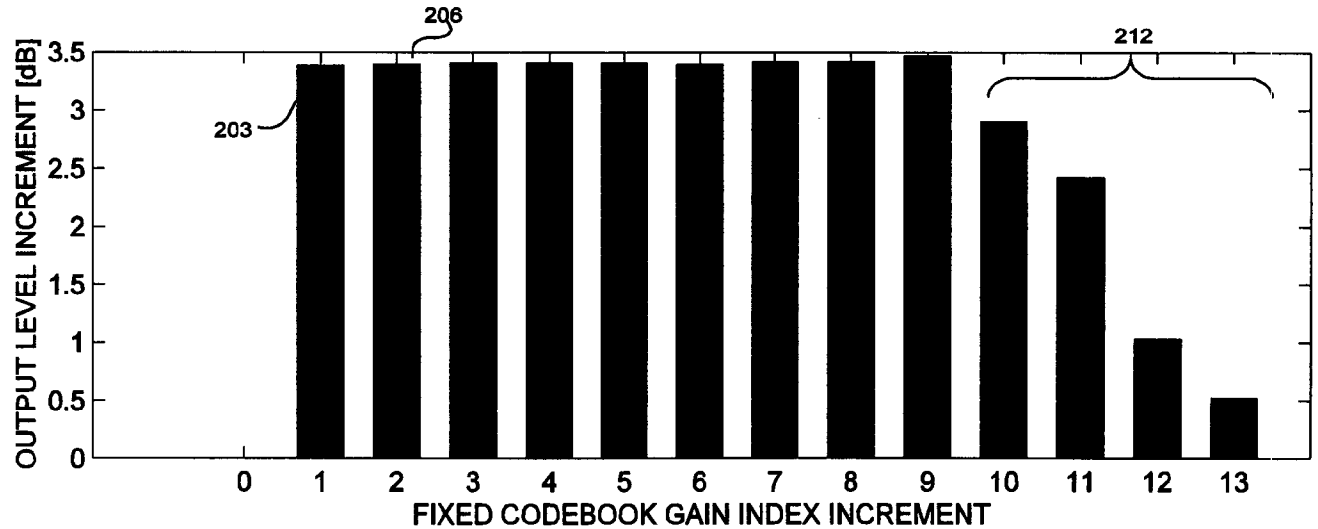
Figure 4A:
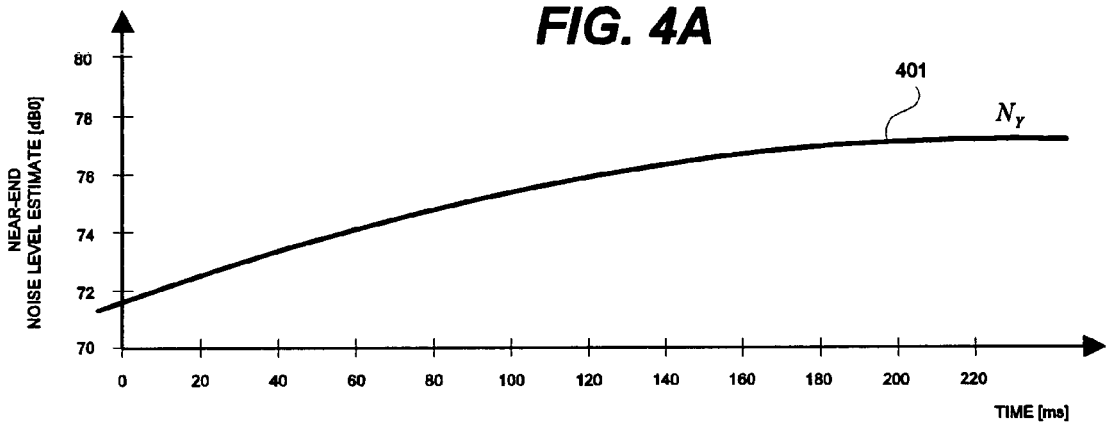
FIGS. 4A, 4B, and 4C show graphical plots illustrating the effect of incrementing fixed codebook gain according to the principles of invention.
Figure 4B:
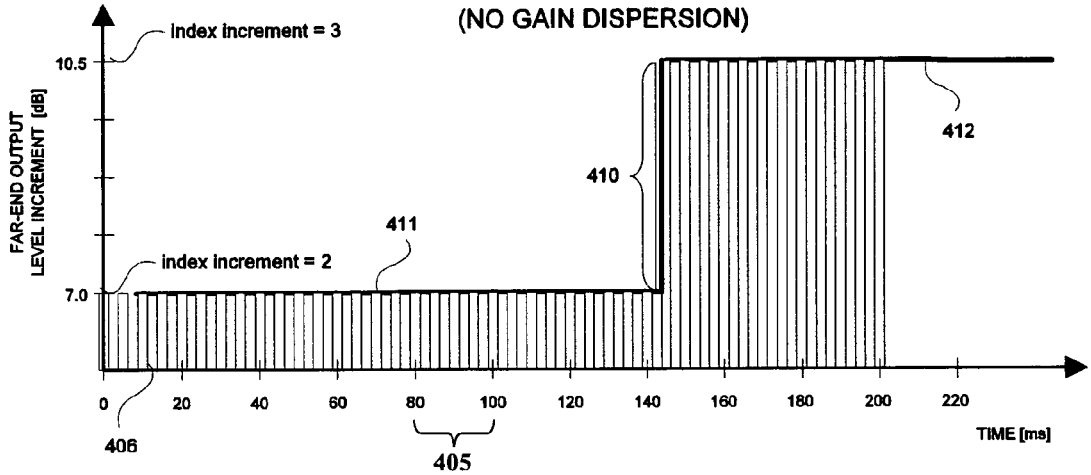
Figure 4C:
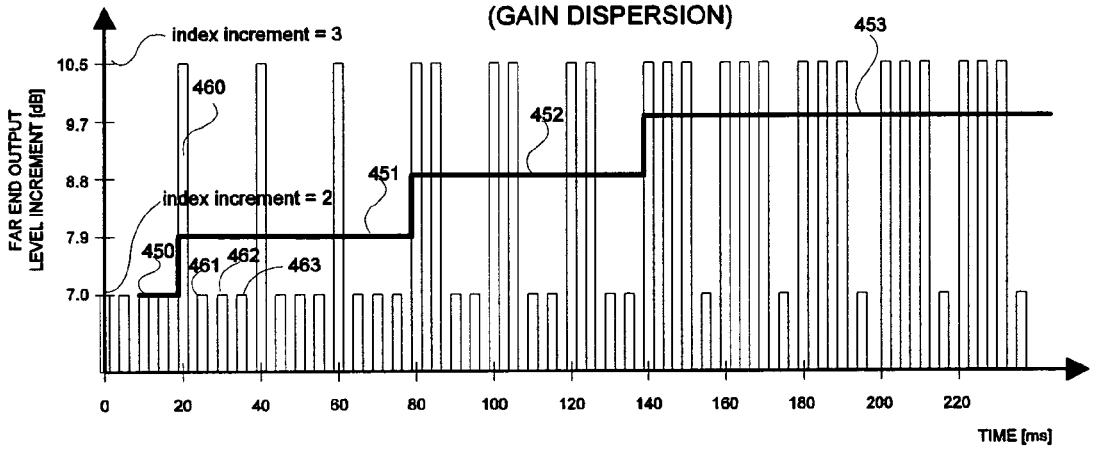

FIG. 4 illustrates how temporal gain dispersion is applied according to the principles of the invention in the context of the noise compensation examples shown in FIGS. 1 through 3. FIGS. 4B and 4C show the difference between modifying gain using coarse adjustments without the benefit of the inventive principles (FIG. 4B) and modifying gain with temporal dispersion according to the principles of the invention (FIG. 4C). For both examples, FIG. 4A represents the near-end noise level estimate 401 as a function of time, e.g., noise estimate $N_Y$ generated by noise estimator 104 (FIGS. 2 and 3). As previously described, noise compensation can be accomplished by incrementing the far-end fixed codebook gain index based on the near-end noise level.

Referring now to FIG. 4B, noise compensation via fixed codebook gain index modification is shown for the example of the arrangement of FIG. 2. More specifically, FIG. 4B shows a plot of the increment in far-end output level (in dB) over time (ms). As shown, the GSM AMR codec processes frames of 20 ms duration, each of which are further subdivided into four sub-frames of 5 ms duration. Frame 405 and sub-frame 406 are illustrative of this structure. In a conventional, well-known manner, the fixed codebook index is determined on a sub-frame basis in the AMR codec. In this example, the far-end fixed codebook gain index is incremented based on the near-end noise level estimate 401 (FIG. 4A), which results in a corresponding increment in the far-end output level of the signal from level 411 to level 412 shown in FIG. 4B. More specifically, the fixed codebook gain index is incremented from index 2 to index 3 in this example, which corresponds to an increment in output level from approximately 7.0 dB (level 411) to 10.5 dB (level 412).

Continuing with the example described in FIG. 2 for the AMR codec, this output level difference, represented by delta 410, is equivalent to approximately 3.5 dB for just one (1) increment in the fixed codebook gain index, at least in the unsaturated range. As previously described, this large step size produces coarse adjustments, which in turn can result in under-compensation or over-compensation in view of the actual signal conditions. Furthermore, there is delay in compensating for noise when modifying the gain of the signal in this manner, e.g., 140 ms in this example before the gain and output level is incremented, a time span, which may however be much larger for other noise conditions.

FIG. 4C illustrates how time-based (temporal) gain dispersion is carried out (e.g., via gain dispersion unit 312 and index computation unit 110 in FIG. 3) according to the principles of the invention. More specifically, the fixed codebook gain index is incremented in a cyclical manner over many sub-frames so that the increment in fixed codebook gain is effectively dispersed over time. In the illustrative example shown in FIG. 4C, the cycle period is selected to be four (4), i.e., CYCLE_PERIOD=4.

For illustration purposes, consider sub-frames 460-463 as representing one cycle in which the fixed codebook gain is maintained at index level 2 (corresponding output level 7.0 dB) for three (3) sub-frames and raised to index level 3 (corresponding output level 10.5 dB) for one (1) sub-frame. By incrementing the fixed codebook gain by one index over just one (1) of the four (4) sub-frames in that cycle, the far-end output level is increased by approximately 0.9 dB to 7.9 dB (from level 450 to 451) since the gain index was incremented in a cyclical manner over the 20 ms frame. Continuing with this example, consider that this pattern is repeated (e.g., 1 sub-frame at gain index increment 3 and 3 sub-frames at gain index increment 2) for several frames, thus resulting in the far-end output level remaining at 7.9 dB (level 451). At approximately 80 ms (the $5^{th}$ frame), the pattern changes such that the gain index is kept at index increment 2 for 2 sub-frames and at index increment 3 for 2 sub-frames, thus resulting in an increment in output level (from level 451 to 452) by another 0.9 dB to 8.8 dB. This pattern continues for a few more cycles to maintain the output level at 8.8 dB until the pattern changes again to 3 sub-frames at gain index increment 3 and 1 sub-frame at gain index increment 2); and so on.

For comparison purposes, consider that the pattern of the gain index increment in FIG. 4C follows the sequence 2222-3222-3222-3222-3322-3322-3322-3332-3332-3332 . . . , while the pattern for the conventional technique (coarse adjustments) shown in FIG. 4B follows the sequence 2222-2222-2222-2222-2222-2222-2222-3333-3333-3333-3333 . . . and so on. The difference between these two sequences is the previously introduced cyclical increment $\Delta_{INC}$, which here becomes 0000-1000-1000-1000-1100-1100-1100-1110-1110-1110- . . . and so on. It should be noted that parameters such as cycle period, amount of the index increment (1,2,3, . . . ), location of the cyclical increment $\Delta_{INC}$ and so on are matters of design choice and the examples shown in the illustrative embodiments herein are not meant to be limiting in any manner. For example, the illustrative embodiments were shown in the context of the AMR codec and its corresponding frame/sub-frame structure, but the principles of the invention are equally applicable and advantageous in other applications. Accordingly, various modifications will be apparent to those skilled in the art and are contemplated by the teachings herein.

Incrementing the fixed codebook gain index in a cyclical manner according to the principles of the invention effectively disperses the gain index increment over time. That is, by dispersing the increment in fixed codebook gain index over many sub-frames in a cyclical manner, a more gradual adjustment in the far-end output level can be achieved. In the example shown in FIG. 4C, the steps (increments) in far-end output level are approximately 0.9 dB as compared to the coarser adjustments on the order of 3.5 dB in the prior arrangements. At a high level, one can readily see that the far-end fixed codebook gain is adjusted in smaller increments in the average and, as a result, the far-end output level increases in smaller increments (from levels 450 through 453) over time. Consequently, higher resolution in the adjustment (e.g., fine tuning) of the fixed codebook gain provides for more granularity in the adjustments in far-end signal output level to more precisely match signal conditions. Moreover, the delay or response time may be much shorter, e.g., adjustments are made much earlier and the signal conditions, e.g. the near-end noise for the example shown in FIG. 4A, are tracked better.

Figure 5:
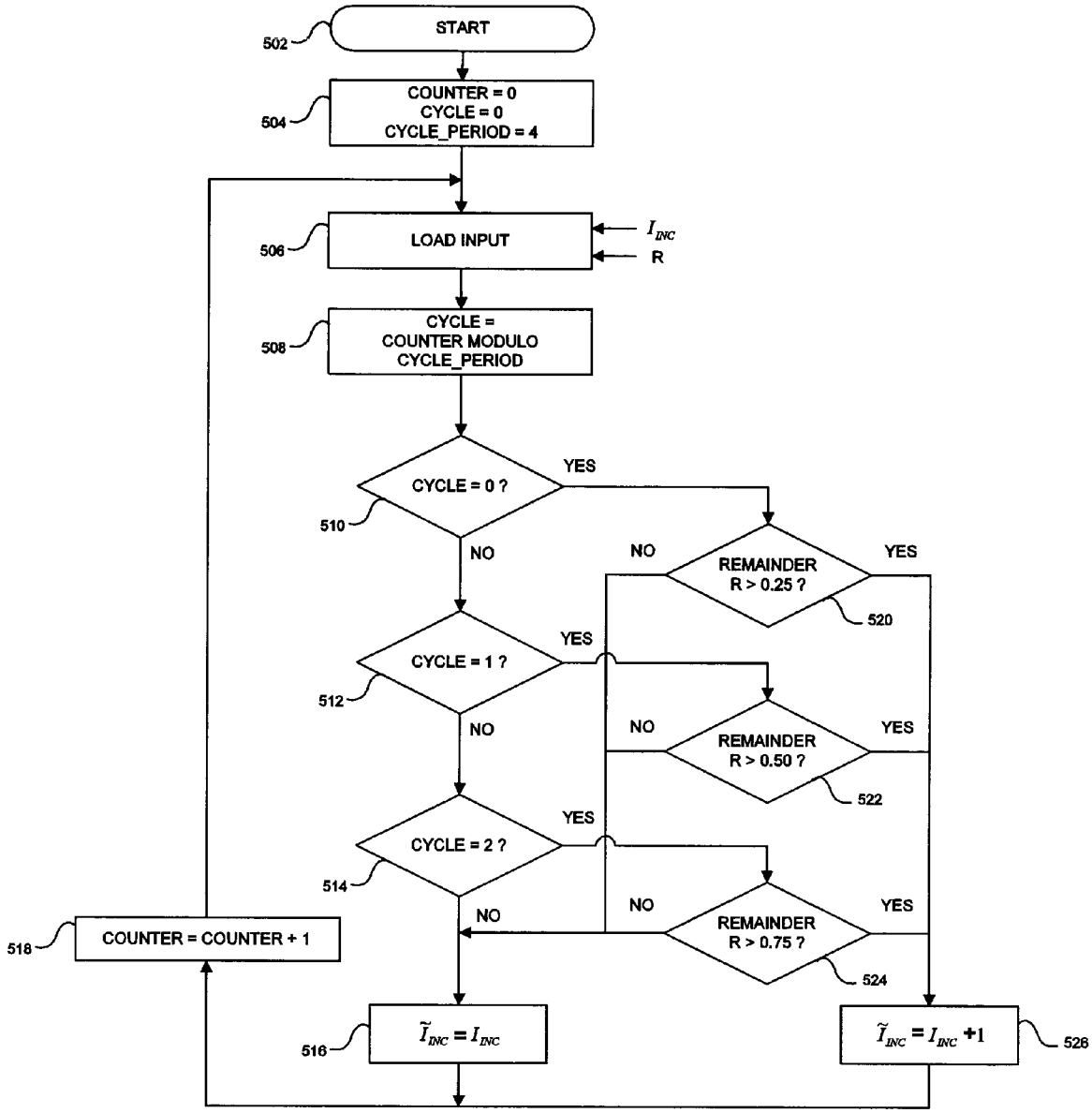
FIG. 5 is a flow diagram of one illustrative embodiment of a method according to the principles of the invention.

FIG. 5 shows an illustrative embodiment of a method for performing temporal gain dispersion according to the principles of the invention. For example, the steps shown in FIG. 5 could be implemented in an algorithm for carrying out the function of gain dispersion unit 312 from FIG. 3. Therefore, FIG. 5 shows an algorithm to compute the time-dispersed index increment $\tilde{I}_{INC}$ from the base index increment $I_{INC}$ and the quantization error or remainder R.

As shown, the routine starts at step 502. In step 504, the parameters COUNTER, CYCLE, and CYCLE_PERIOD are initialized. In this example, COUNTER and CYCLE are set to a value of 0, while CYCLE_PERIOD is set to a value of 4 continuing with the example shown in FIG. 4C. As noted above, these examples are only meant to be illustrative and not limiting in any manner. Using a CYCLE_PERIOD of 4, a gain index increment of 3.5 dB can be further sub-quantized into 4 levels of about 0.9 dB each. By way of example, 0.9 dB represents approximately the smallest sound level difference potentially perceivable by the human ear.

In step 506, the index increment $I_{INC}$ and the remainder R are used as input to the algorithm. In step 508 the variable CYCLE is determined by taking COUNTER modulo CYCLE_PERIOD. The modulo operation is equivalent to first dividing COUNTER by CYCLE_PERIOD and then taking the remainder. For example, with CYCLE_PERIOD=4 and a COUNTER sequence of 0-1-2-3-4-5-6-7-8-9. . . , the resulting CYCLE variable sequence will be 0-1-2-3-0-1-2-3-0-1- . . . In step 510, the variable CYCLE is compared with zero (0). If CYCLE equals zero, step 520 is performed next, otherwise, step 512 is performed next. In step 520, the remainder R, one of the input variables of the algorithm, is compared with 0.25. If remainder R is greater than 0.25, step 526 is performed next, otherwise step 516 is performed next. In step 526, the time-dispersed index increment $\tilde{I}_{INC}$ is computed by adding one to the base increment $I_{INC}$, while in step 516, the time-dispersed index increment $\tilde{I}_{INC}$ is set equal to the base increment $I_{INC}$ Steps 512, 514, 522, and 524 are carried out similar to steps 510 and 520, and are, for sake of brevity, not described again in detail. After the time-dispersed index increment $\tilde{I}_{INC}$ was set in either step 516 or step 526, the variable COUNTER is incremented by one in step 518. The next subframe is then processed by loading the new inputs in step 506.

To relate FIG. 5 now to FIG. 4C, consider the index increment at time 0 ms. Here, remainder R is smaller than 0.25, therefore the path through the flowchart in FIG. 5 is via steps 510, 512, 514, and 516. The same path is taken for the next three sub-frames. At time 20 ms, R has taken on a value between 0.25 and 0.5, causing the path through the flowchart via steps 510, 520, 526 (FIG. 5), which will provide the index increment of 3 shown by reference 460 (FIG. 4C). Index increment 461 (FIG. 4C) is then computed by passing through steps 510, 512, 522, and 516 (FIG. 5). Next, index increment 462 (FIG. 4C) is computed by passing through steps 510, 512, 514, 524, and 516 (FIG. 5). Finally, index increment 463 is computed by passing through steps 510, 512, 514, and 516, and so on.

Figure 6:
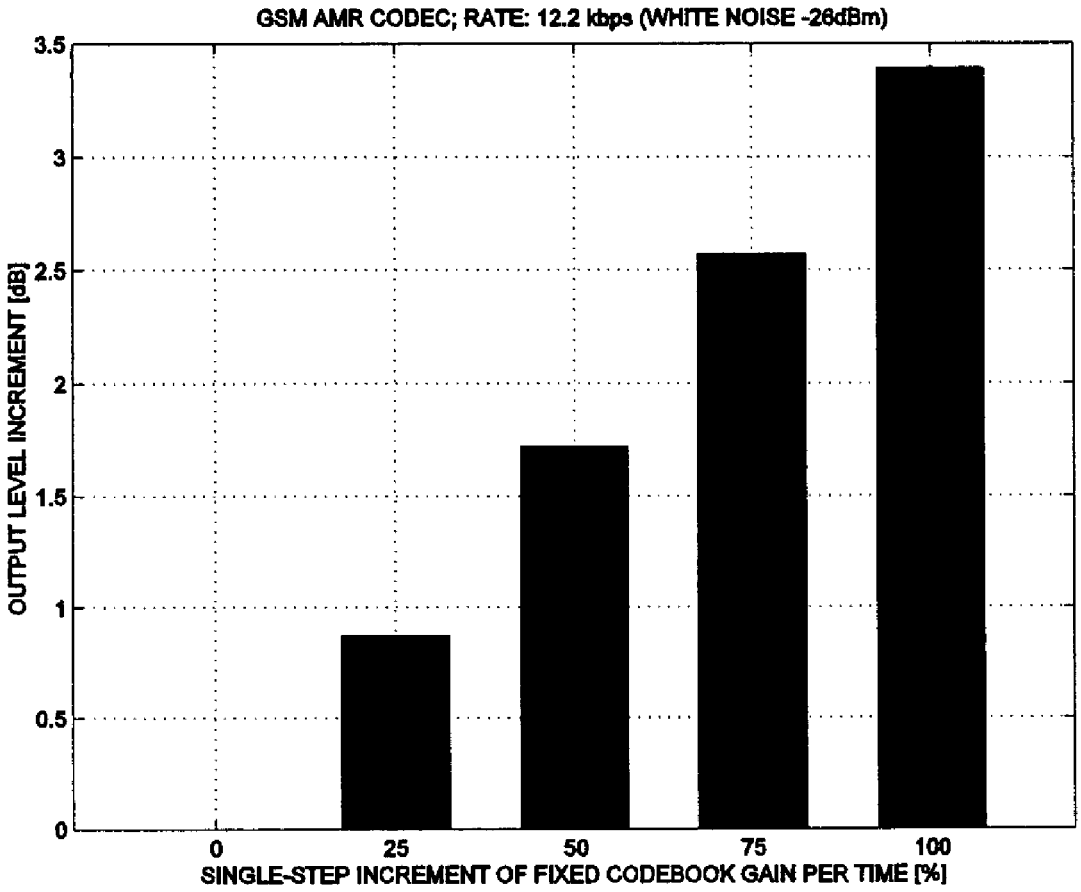
FIG. 6 shows a graphical plot illustrating the results achieved according to the principles of the invention.

FIG. 6 shows experimental results of the measured quantization when the white noise signal is applied to the encoder. More specifically, FIG. 6 shows the change (increment) in the far-end output level (dB) as a function of the percentage of a single step increment in the fixed codebook gain index over time. Consistent with the previous illustrations, temporal gain dispersion according to the principles of the invention results in steps (increments) of 0.9 dB for the case of white noise and a cycle period of four (CYCLE_PERIOD=4). The 25% single-step increment (i.e., 25% of the time the cyclical increment $\Delta_{INC}$ becomes 1) is generated by a time-dispersed index increment $\tilde{I}_{INC}$ sequence of 1000-1000-1000- . . . , the 50% single-step increment by a time-dispersed index increment $\tilde{I}_{INC}$ sequence of 1100-1100-1100- . . . , the 75% single-step increment by a time-dispersed index increment $\tilde{I}_{INC}$ sequence of 1110-1110-1110- . . . , and the 100% single-step increment by a time-dispersed index increment $\tilde{I}_{INC}$ sequence of 1111-1111-1111-1111- . . . .

In general, the foregoing embodiments are merely illustrative of the principles of the invention. Those skilled in the art will be able to devise numerous arrangements and modifications, which, although not explicitly shown or described herein, nevertheless embody those principles that are within the scope of the invention. For example, the invention was described in the context of certain illustrative embodiments. While various examples were also given for possible modifications or variations to the disclosed embodiments, it is contemplated that other modifications and arrangements will also be apparent to those skilled in the art in view of the teachings herein. Accordingly, the embodiments shown and described herein are only meant to be illustrative and not limiting in any manner.

Moreover, all statements herein reciting principles, aspects, and embodiments of the invention, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure. Thus, for example, it will be appreciated by those skilled in the art that any block diagrams herein represent conceptual views of illustrative circuitry embodying the principles of the invention. Similarly, it will be appreciated that any flow charts, flow diagrams, state transition diagrams, pseudocode, and the like represent various processes which may be substantially represented in computer readable medium and so executed by a computer or processor, whether or not such computer or processor is explicitly shown.

The functions of the various elements shown in the figures, including any functional blocks labeled as "processors", may be provided through the use of dedicated hardware as well as hardware capable of executing software in association with appropriate software. When provided by a processor, the functions may be provided by a single dedicated processor, by a single shared processor, or by a plurality of individual processors, some of which may be shared. Moreover, explicit use of the term "processor" or "controller" should not be construed to refer exclusively to hardware capable of executing software, and may implicitly include, without limitation, digital signal processor (DSP) hardware, network processor, application specific integrated circuit (ASIC), field programmable gate array (FPGA), read-only memory (ROM) for storing software, random access memory (RAM), and non-volatile storage. Other hardware, conventional and/or custom, may also be included. Similarly, any switches shown in the FIGS. are conceptual only. Their function may be carried out through the operation of program logic, through dedicated logic, through the interaction of program control and dedicated logic, or even manually, the particular technique being selectable by the implementer as more specifically understood from the context.

Software modules, or simply modules which are implied to be software, may be represented herein as any combination of flowchart elements or other elements indicating performance of process steps and/or textual description. Such modules may be executed by hardware that is expressly or implicitly shown.

In the claims hereof any element expressed as a means for performing a specified function is intended to encompass any way of performing that function including, for example, a) a combination of circuit elements which performs that function or b) software in any form, including, therefore, firmware, microcode or the like, combined with appropriate circuitry for executing that software to perform the function. The invention as defined by such claims resides in the fact that the functionalities provided by the various recited means are combined and brought together in the manner which the claims call for. Applicant thus regards any means which can provide those functionalities as equivalent as those shown herein. Finally, the scope of the invention is limited only by the claims appended hereto.

What is claimed is:

1. A method for modifying the level of a speech signal, wherein the speech signal is encoded as a bit stream, the method comprising:

using a processor changing a fixed codebook gain index in the encoded speech signal by maintaining the fixed codebook gain index at a first index increment value for a first portion of a cycle period; and incrementing the fixed codebook gain index to a second index increment value for the remaining portion in that cycle period, so that the increment in fixed codebook gain index is variable and temporally dispersed.

2. The method according to claim 1, wherein a first cycle period is defined by a pattern of index increment values, the method further comprising the step of repeating the pattern in one or more subsequent cycle periods.

3. The method according to claim 1, wherein a first cycle period is defined by a pattern of index increment values, the method further comprising the step of changing the pattern in one or more subsequent cycle periods.

4. A method for modifying the level of a speech signal, wherein the speech signal is encoded as a bit stream such that the speech signal is transported in one or more frames, each frame including a plurality of sub-frames, the method comprising:

using a processor changing a fixed codebook gain index in the encoded speech signal by maintaining the fixed codebook gain index at a first index increment value for one or more sub-frames in a cycle period; and incrementing the fixed codebook gain index to a second index increment value for the remaining portion in that cycle period, wherein a predetermined number of sub-frames define a cycle period, so that the increment in fixed codebook gain index is variable and temporally dispersed over one or more sub-frames.

5. The method according to claim 4, wherein a first cycle period is defined by a pattern of index levels by sub-frame, the method further comprising the step of repeating the pattern in one or more subsequent cycle periods.

6. The method according to claim 4, wherein a first cycle period is defined by a pattern of index levels by sub-frame, the method further comprising the step of changing the pattern in one or more subsequent cycle periods.

7. An apparatus for modifying a bit stream corresponding to a speech signal, wherein the bit stream carries the speech signal in frames, each frame including a plurality of sub-frames, the apparatus comprising:

a decoding element for extracting a fixed codebook gain index from the bit stream; and a gain dispersion processor for changing the fixed codebook gain index by maintaining the fixed codebook gain index at a first index increment value for one or more sub-frames in a cycle period, and incrementing the fixed codebook gain index to a second index increment value for the remaining sub-frames in that cycle period, wherein a predetermined number of sub-frames define a cycle period, so that the increment in fixed codebook gain index is variable and temporally dispersed over one or more sub-frames.

8. The apparatus according to claim 7, wherein a first cycle period is defined by a pattern of index levels by sub-frame, the gain dispersion unit being further operable to repeat the pattern in one or more subsequent cycle periods.

9. The apparatus according to claim 7, wherein a first cycle period is defined by a pattern of index levels by sub-frame, the gain dispersion unit being further operable to change the pattern in one or more subsequent cycle periods.

* * * * *